US006908210B2

(12) United States Patent
Kuo

(10) Patent No.: US 6,908,210 B2
(45) Date of Patent: Jun. 21, 2005

(54) SNORKEL WITH LIGHT-EMITTING DEVICE

(76) Inventor: Tzong-Fuh Kuo, No. 21, Alley 5, Lane 49, How Gaang 1st Rd., Hsin Juang City, Taipei Hsien (TW)

( * ) Notice: Subject to any disclaimer, the term of this patent is extended or adjusted under 35 U.S.C. 154(b) by 63 days.

(21) Appl. No.: 10/647,327

(22) Filed: Aug. 26, 2003

(65) Prior Publication Data

US 2005/0047122 A1 Mar. 3, 2005

(51) Int. Cl.[7] ..... F21L 4/00

(52) U.S. Cl. ..... 362/158; 362/101; 362/105; 128/205.23

(58) Field of Search ..... 362/101, 103, 362/105, 158, 267; 128/201.11, 201.27, 205.23

(56) References Cited

U.S. PATENT DOCUMENTS

| | | | | | |
|---|---|---|---|---|---|
| 3,836,762 | A | * | 9/1974 | Thomason | 362/186 |
| 5,183,326 | A | * | 2/1993 | Case | 362/191 |
| 5,622,422 | A | * | 4/1997 | Rodgers | 362/158 |
| 5,701,884 | A | * | 12/1997 | Fondas et al. | 128/201.11 |
| 6,745,762 | B1 | * | 6/2004 | Shiue | 128/201.11 |

* cited by examiner

*Primary Examiner*—John Anthony Ward
(74) *Attorney, Agent, or Firm*—Bacon & Thomas PLLC

(57) ABSTRACT

A snorkel light-emitting device having a light-emitting unit, a float, an inner cap, a circuit board, an upper cap and a button. The light-emitting device is fastened to a topmost portion of a snorkel tube. When a user is diving, the light-emitting device is entirely out of the water, and is so constructed to be absolutely watertight.

3 Claims, 4 Drawing Sheets

SNORKEL WITH LIGHT-EMITTING DEVICE

BACKGROUND OF THE INVENTION (a) Field of the Invention

The present invention relates to a watertight light-emitting device configured on a snorkel tube, and more particularly to providing an emitting light or flashing light from the snorkel tube for when a diver is floating on the water surface. The light-emitting device is advantageous to the diver by providing a warning sign easily seen by sailing vessels, speeding motorboats or other companions, thereby safeguarding the safety of the diver.

(b) Description of the Prior Art

Referring to FIG. 1, for safety considerations, a typical diver when floating on the water surface adheres a strip of light-reflecting tape 200 around the topmost of the snorkel tube. The reflecting light emanating from the light-reflecting tape 200 relies on sunlight, whereby sailing vessels, speeding motorboats or accompanying companions are enabled to clearly see the location of the diver, thereby safeguarding the safety of the diver, and preventing any sailing vessels or motorboats from colliding with the diver, as well as facilitating companions locating the position of the diver. However, the light-reflecting tape 200 still possesses shortcomings, for example, when being used on cloudy days or at night time when sunlight is lacking, making it impossible to implement the effectiveness of the light-reflecting warning, resulting in accidents often occur whereby the diver is hit by a sailing vessel or speeding motorboat. Difficulties even arise because the diver has lost direction and unable to locate their companions.

Referring to prior art U.S. Pat. Nos. 5,622,422, 5,553,606, and 5,701,884, the light-emitting devices are all for usage under the water surface, resulting in the brightness of the emitting light being insufficient for anyone above the surface to notice, and only able to provide sufficient light for companions in the vicinity to see. Moreover, the structure of the aforementioned patents are very simple, only taking into consideration the light-emitting feature of the light bulb or LED, and not enhancing the water proofing effectiveness of the unit itself, thus resulting in the light-emitting device easily faltering or failing upon immersing in the water.

SUMMARY OF THE INVENTION

The primary objective of the present invention is to provide a light-emitting device attached to a topmost portion of snorkel. The light-emitting device comprises batteries to supply electricity to LEDs. Upon pressing down on a button configured on the head of the light-emitting device, a switch on a circuit board is actuated, thereupon light is emitted through the transparent light-emitting device thereof. The light-emitting device is applicable for usage by divers on cloudy days or when diving at night, whereby a safety warning effectiveness is maintained, thus preventing being hit by sailing vessels or speeding motorboats, and safeguarding the safety of the diver thereof. Moreover, the light-emitting device facilitates fellow companions finding a diver should the diver lose their direction.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
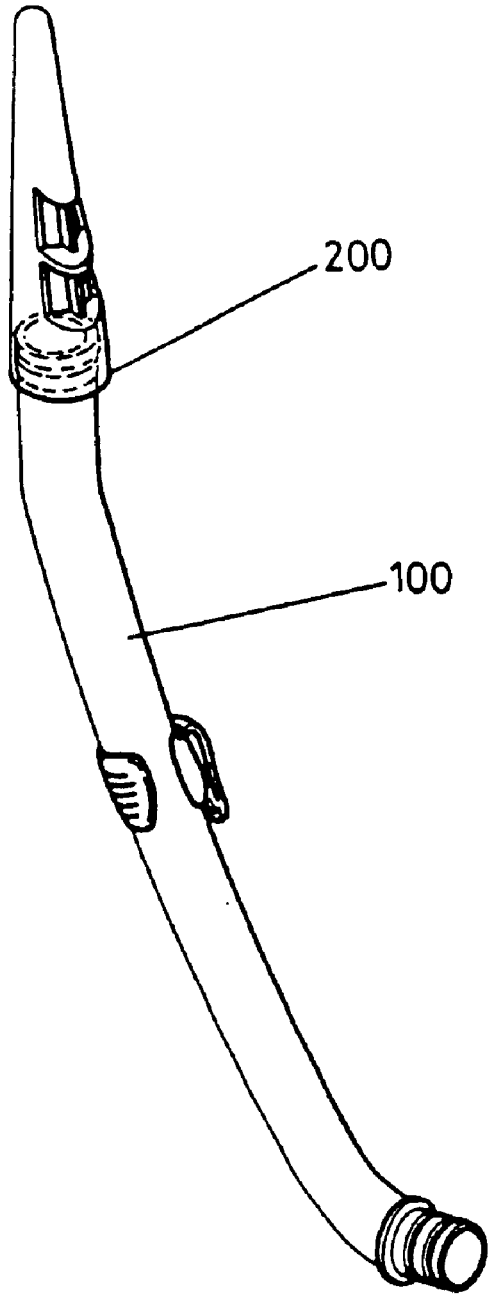
FIG.1 (PRIOR ART)
FIG. 1 shows a schematic view of a conventional snorkel system.
Figure 2:
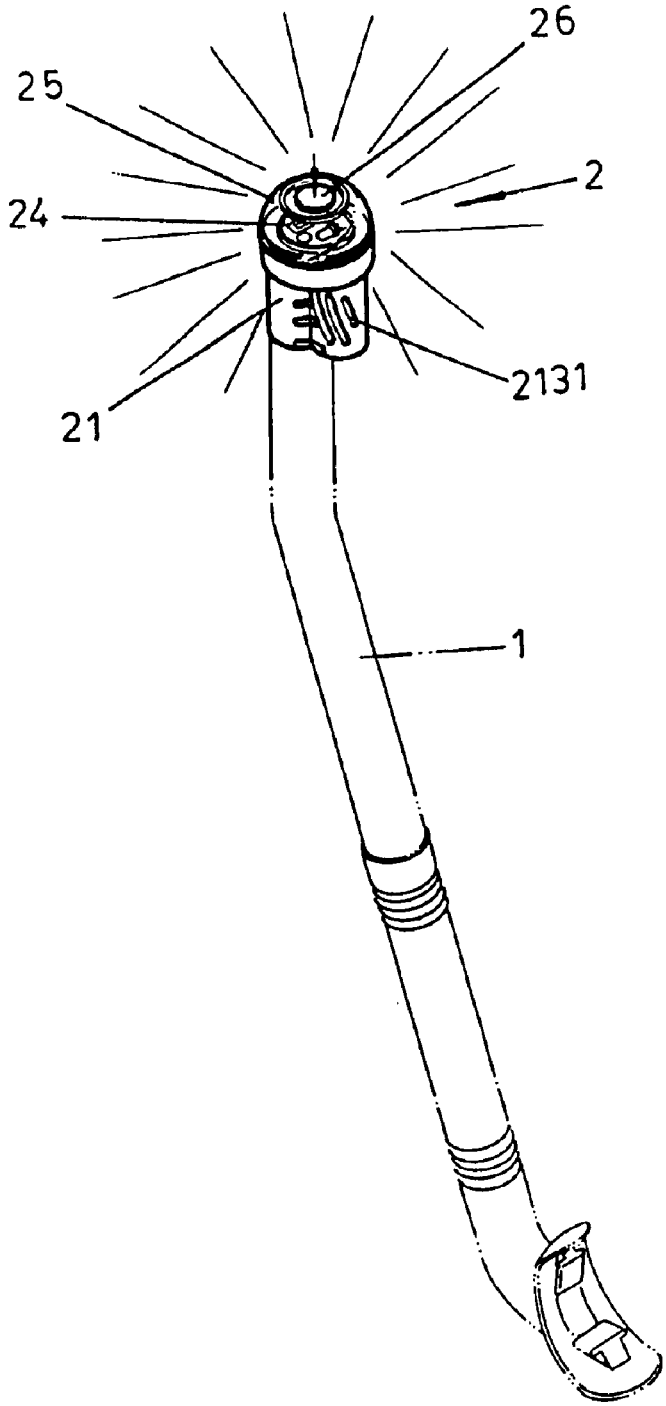
FIG. 2 shows a schematic view according to the present invention.
Figure 3:
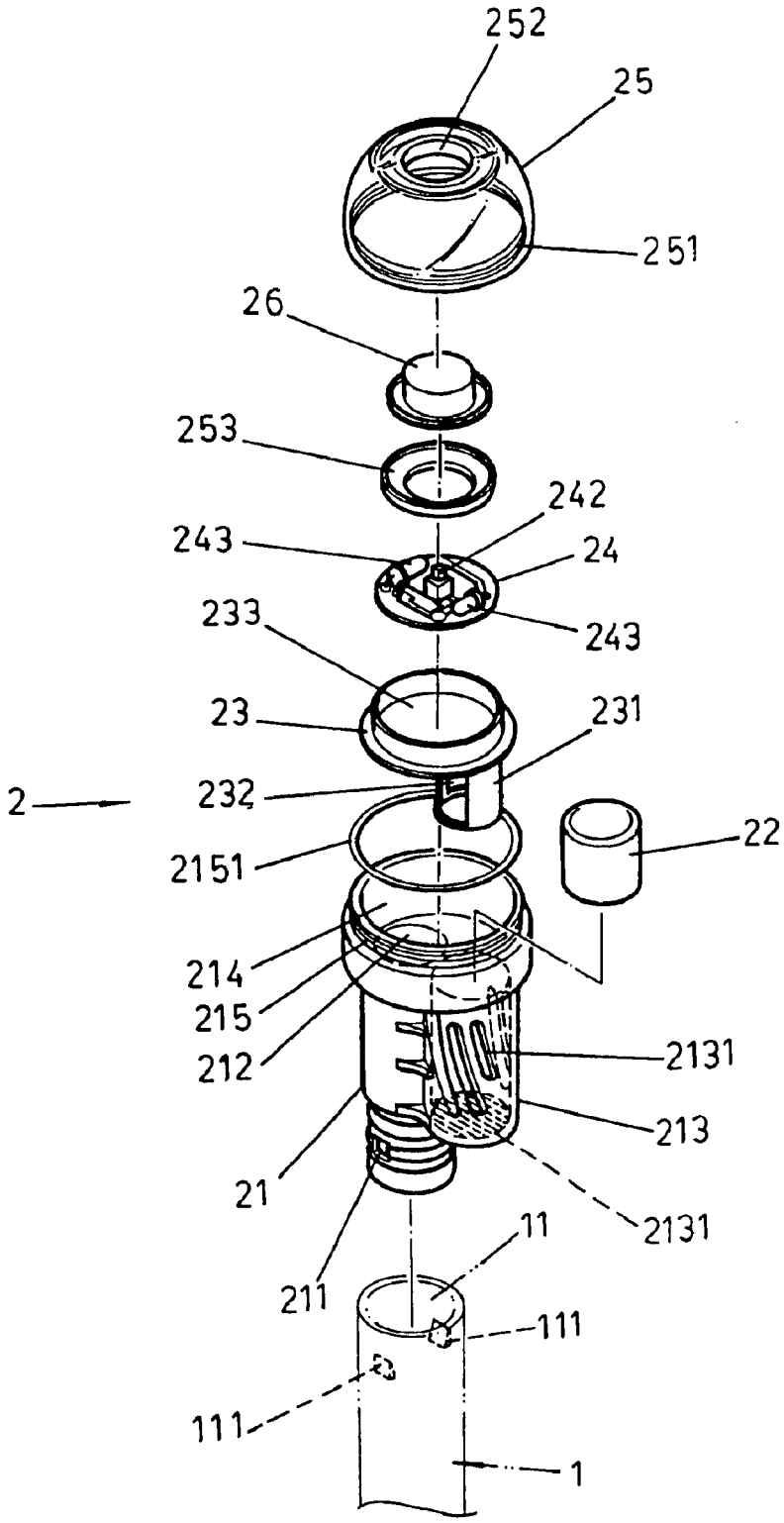
FIG. 3 shows an exploded elevational view of the light-emitting device according to the present invention.
Figure 4:
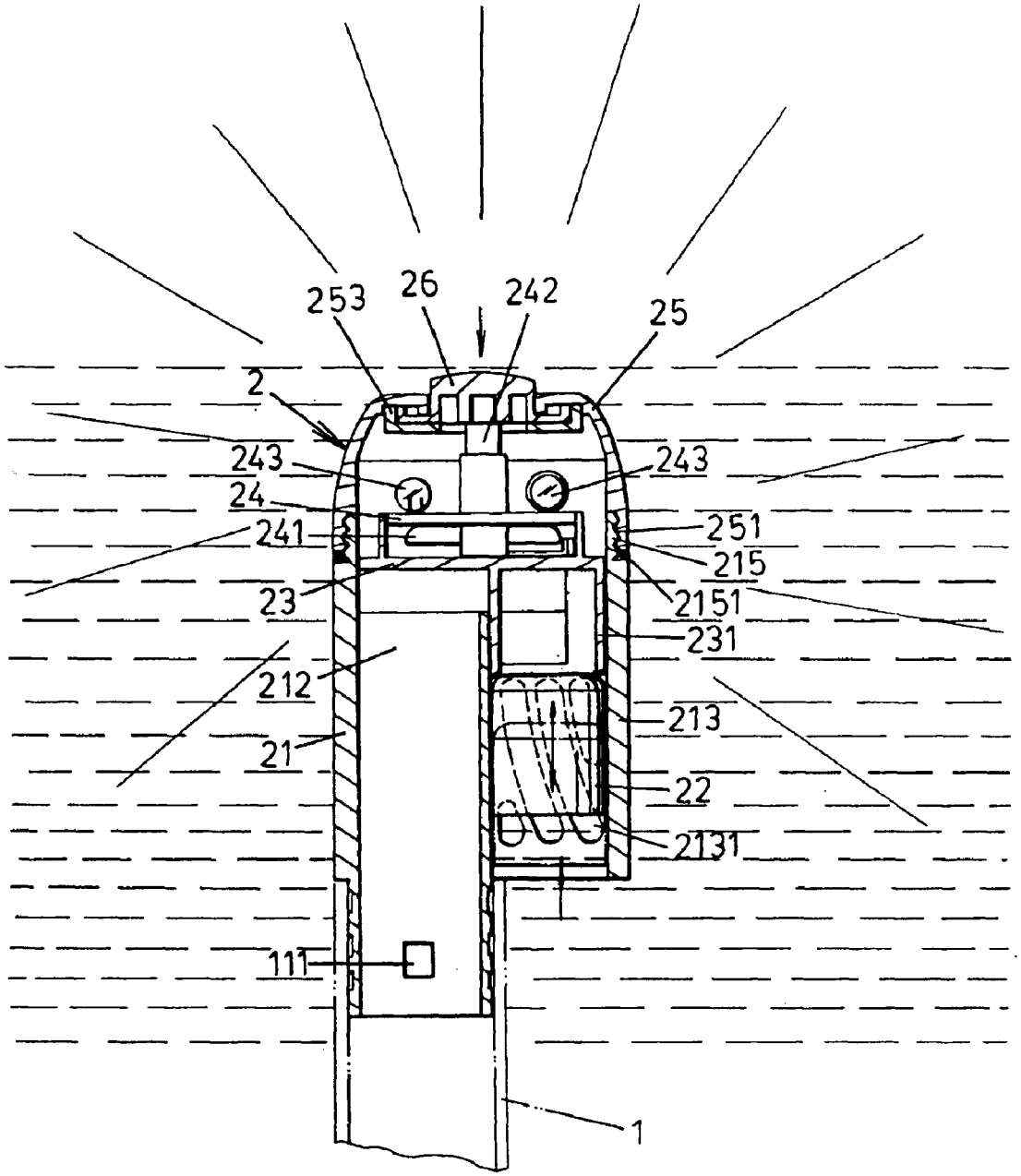
FIG. 4 shows a cross sectional view of the light-emitting device according to the present invention.

Referring to FIGS. 2, 3 and 4, two tapered catches 111 are configured on inner edges of a topmost open-end of a snorkel tube 1, two catch slots 211 defined in a lower end of a light-emitting unit 21 of a light-emitting device 2 facilitates the catches 111 slotting into thereof, thereby securing the fastening. The main features of the present invention include:

A transparent light-emitting device 2 mounted on the topmost portion of a snorkel tube. The light-emitting device 2 comprises and is constructed from a light-emitting unit 21, a float 22, an inner cap 23, a circuit board 24, an upper cap 25, and a button 26. In one section of the light-emitting unit 21 is defined a tubular hole 212, one side of which is attached a compartment 213 defined to dispose a float 22 therein. The bottom and sidings of the compartment 213 are configured with a plurality of openings 2131, which facilitate entry of air or water into the float 22 allowing the float 22 to rise upward. The inner cap 23 is designed to be circular in shape, whereby it can be lodged into a circular valve 214 defined in the topmost portion of the light-emitting unit 21. A cut-off tube 231 is affixed to the lower end of the inner cap 23, and is designed to fit into the compartment 213. An air hole 232 is defined in the siding of the cut-off tube 231, and is configured to orient a passageway with the circular valve 214 and the tubular hole 212. In case of the snorkel light-emitting device immersing below the water surface, the float 22 thereupon floats upwards and obstructs a hole at the lower end of the cut-off tube 231, thereby preventing water in the compartment 213 from entering the tubular hole 212 and consequently stopping water from flowing into the mouth of the diver (see FIG. 4 ).

A PC circuit slot 233 defined in a top end of the inner cap 23 is configured for the circuit board 24 to be fitted into thereof. Batteries 241 are installed at the bottom of the circuit board 24 (see FIG. 4). A switch 242 and two LED lights 243 are configured on top of the PC circuit 24. Outer threads 215 configured on outside of an upper section of the light-emitting unit 21 are designed such that inner threads 251 configured on a lower edge of the upper cap 25 can be screwed tight onto thereof. Moreover, a watertight washer 2151 is slipped onto a lower end of the outer threads 215 of the light-emitting unit 21, thereby preventing water from permeating into the light-emitting unit 21 thereof. A round aperture 252 defined in a topmost of the upper cap 25 is configured to allow a soft, rubber button 26 to protrude and be depressible therein. A lower end of the button 26 is designed to lodge into a disc 253 thereof. The disc 253 can be tightly joined to the upper cap 25 by means of machine thermal compression. Upon depressing the button 26, a switch 242 is actuated; thereby the LED lights 243 commence emitting light. Pressing the button 26 once more de-actuates the LED lights and turns off their lights thereon.

In conclusion, the present invention comprises a watertight light-emitting device configured on the topmost of a snorkel tube, and distinct from the aforementioned cited patents, which are configured, for usage under the water surface. The objective of the present invention is to provide the topmost of a snorkel tube with a device enabled to emit light or strobe lighting for when a diver is on the water surface. On cloudy days or at nighttime when sunlight is lacking, the emitting light facilitates being seen by sailing vessels or speeding motorboats, thereby safeguarding the safety of the diver.

It s of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A light-emitting device for attachment to a topmost portion of a snorkel tube, the device comprising:

a) a light-emitting unit including a tubular hole defined in the unit, a compartment attached to a side of the unit, a plurality of openings formed in a wall of the compartment, an upper section having a circular valve, an outer periphery of the circular valve provided with threads, and a water tight washer at a lower edge of the threads;

b) a float disposed in the compartment for buoying upwardly in response to water flowing into the compartment through the openings;

c) a circular-shaped inner cap disposed in the circular valve, the inner cap including a slot, a cutoff tube secured to a lower end of the inner cap, the cutoff tube being received within the compartment and having an air hole, wherein the air hole, circular valve and tubular hole collectively form a passageway;

d) a circuit board disposed in the slot of the inner cap, the circuit board including a battery, a switch and at least one light emitting diode;

e) an upper cap including an inner periphery provided with threads, the threads of the upper cap being engageable with the threads of the circular valve, an inner circular edge of the upper cap defining an aperture in a topmost portion of the upper cap, a depressable button extending from the aperture, a disc joined to the upper cap, a lower end of the button being engaged by the disc; and f) wherein depressing the button activates the switch of the circuit board to turn the at least one light-emitting diode on or off.

2. The light-emitting device of claim 1, further including two catch slots formed in a lower end thereof for engagement by two catches of a snorkel tube.

3. The light-emitting device of claim 1, wherein the button is formed from soft material and includes a bottom portion for engaging the switch of the circuit board.

* * * * *